United States Patent [19]

Bettigole

[11] Patent Number: 4,531,857

[45] Date of Patent: Jul. 30, 1985

[54] PREFABRICATED PAVEMENT MODULE

[76] Inventor: Neal H. Bettigole, 89 Howard Dr., Old Tappan, N.J. 07675

[21] Appl. No.: 428,861

[22] Filed: Sep. 30, 1982

[51] Int. Cl.[3] ..... E01C 5/22

[52] U.S. Cl. ..... 404/44; 404/45; 14/73; 52/666; 52/309.17

[58] Field of Search ..... 404/18, 34, 35, 44, 404/45; 14/73, 6; 52/333, 334, 408, 411, 666–668, 309.17

[56] References Cited

U.S. PATENT DOCUMENTS

| | | | |
|---|---|---|---|
| 185,302 | 12/1876 | Davison | 404/18 |
| 1,033,106 | 7/1912 | Kahn | 52/88 |
| 1,300,439 | 4/1919 | Madison | 404/18 X |
| 1,984,944 | 12/1934 | Piccirilli | 404/34 |
| 2,096,629 | 10/1937 | Farrar et al. | 52/334 X |
| 2,162,742 | 6/1939 | Nagin | 14/73 |
| 2,184,146 | 12/1939 | Leguillon | 404/32 |
| 2,437,095 | 3/1948 | Kähr | 404/18 X |
| 2,880,116 | 3/1959 | Alps et al. | 404/18 X |
| 3,110,049 | 11/1963 | Nagin | 14/73 |
| 3,110,981 | 11/1963 | Larner | 52/408 X |
| 3,260,023 | 7/1966 | Nagin | 14/73 X |
| 3,363,379 | 1/1968 | Curran | 52/334 |
| 3,545,348 | 12/1970 | Anderson | 404/30 |
| 3,855,747 | 12/1974 | Langan | 404/18 X |
| 3,906,571 | 9/1975 | Zetlin | 14/17 |
| 4,102,102 | 7/1978 | Greulich | 14/73 X |
| 4,145,153 | 3/1979 | Fasullo et al. | 404/73 |
| 4,151,025 | 4/1979 | Jacobs | 14/73 X |
| 4,168,924 | 9/1979 | Draper et al. | 404/70 |
| 4,201,023 | 5/1980 | Jungbluth | 52/334 |
| 4,282,619 | 8/1981 | Rooney | 14/6 |
| 4,300,320 | 11/1981 | Rooney | 14/73 X |

*Primary Examiner*—James A. Leppink
*Assistant Examiner*—Beverly E. Hjorth
*Attorney, Agent, or Firm*—Banner, Birch, McKie & Beckett

[57] ABSTRACT

A light weight pavement module is described which comprises a base grating, an impervious intermediate layer, such as a reinforced plastic or fiberglass sheet applied over the base grating, and a concrete top layer wear surface applied over the intermediate layer. The intermediate layer prevents the concrete top layer from penetrating through the base grating. The grating has studs attached to it which pierce the intermediate layer and project into the top layer wear surface in order to form an integral pavement module.

12 Claims, 2 Drawing Figures

PREFABRICATED PAVEMENT MODULE

BACKGROUND OF THE INVENTION

1. Field of the Invention

This invention relates to the construction and repair of bridge decks, roads and sidewalls. In particular, this invention provides an integral, preformed module which can be constructed in a factory under ideal conditions and transported to a construction site to construct or repair a bridge deck, roadway, sidewalk or similar area on which is desired a hard wear surface.

2. Background Art

It is well-known to use modular, precast concrete slabs to construct roadways, sidewalks, bridge decks and similar surfaces. An example of such precast concrete paving slabs which may be set upon a roadway subsurface is disclosed in U.S. Pat. No. 1,984,944. It is also known to reinforce concrete roadways, whether constructed in modular form or as a continuous casting at the job site, with metal or plastic grids, as is disclosed in U.S. Pat. No. 2,184,146 and 4,168,924. These grids, however, are used solely for reinforcement and not as a base for a pavement module. It is also known to use a polyethylene or paper sheet over a base layer of resilient hydrophobic particles to prevent displacement of the particles and to prevent curing of the concrete to the particles, as is disclosed in U.S. Pat. No. 3,545,348.

The prior art precast, modular concrete panels in which a grating or grid is used allow the concrete to fill the interstices of the grating or grid. This results in an extremely heavy modular panel which is unwieldy and costly to transport to construction sites and imposes undesirable dead load which serves no useful purpose in bridge deck construction. Open grating bridge decks without a concrete or similar wear surface are unacceptable because they are too dangerous to traffic.

The invention claimed and described herein uses an impervious intermediate layer to prevent the concrete wear surface from filling the interstices of the base grating. The weight of the panel is approximately 40% of the prior art designs. The intermediate sheet also provides an effective barrier and coating for the grating or grid base support member to protect it from the elements and premature deterioration.

SUMMARY OF THE INVENTION

The invention disclosed and claimed herein is an integral, preformed pavement module. The module is comprised of a base member support for the module, and a top player wear surface on top of the base member. The base layer in the preferred embodiment is a grating which is intended to be placed on the prepared surace of a road bed or on the structural framing for a bridge deck. On top of the grating is an intermediate impervious sheet, which defines the bottom surface of the top layer and serves to prevent the top layer from penetrating the interstices of the grating. The top layer is the wear surface of the pavement module and, in the preferred embodiment, is composed of a concrete formulation suitable as the wear surface.

In order to maintain the structural integrity of the pavement module, in the preferred embodiment the base layer grating is provided with studs or other shear connectors welded to the grating. The studs are essentially perpendicular to the grating. The studs pass through the intermediate sheet and into, but not through, the concrete wear surface layer.

By preventing the concrete wear surface from penetrating the interstices of the grating, a light weight, strong, long wearing readily transportable pavement module is formed. Units of new or replacement pavement can be shipped to the job site for immediate installation and use. The pavement module can be prepared in a factory under ideal conditions to achieve a much high quality wearing surface than can be achieved when such wear surfaces are prepared in the field. Additionally, since the module is ready for immediate installation, construction vagaries, such as weather, can be avoided and traffic and pedestrian inconvenience can be kept to minimum.

DESCRIPTION OF THE PREFERRED EMBODIMENT

Figure 1:
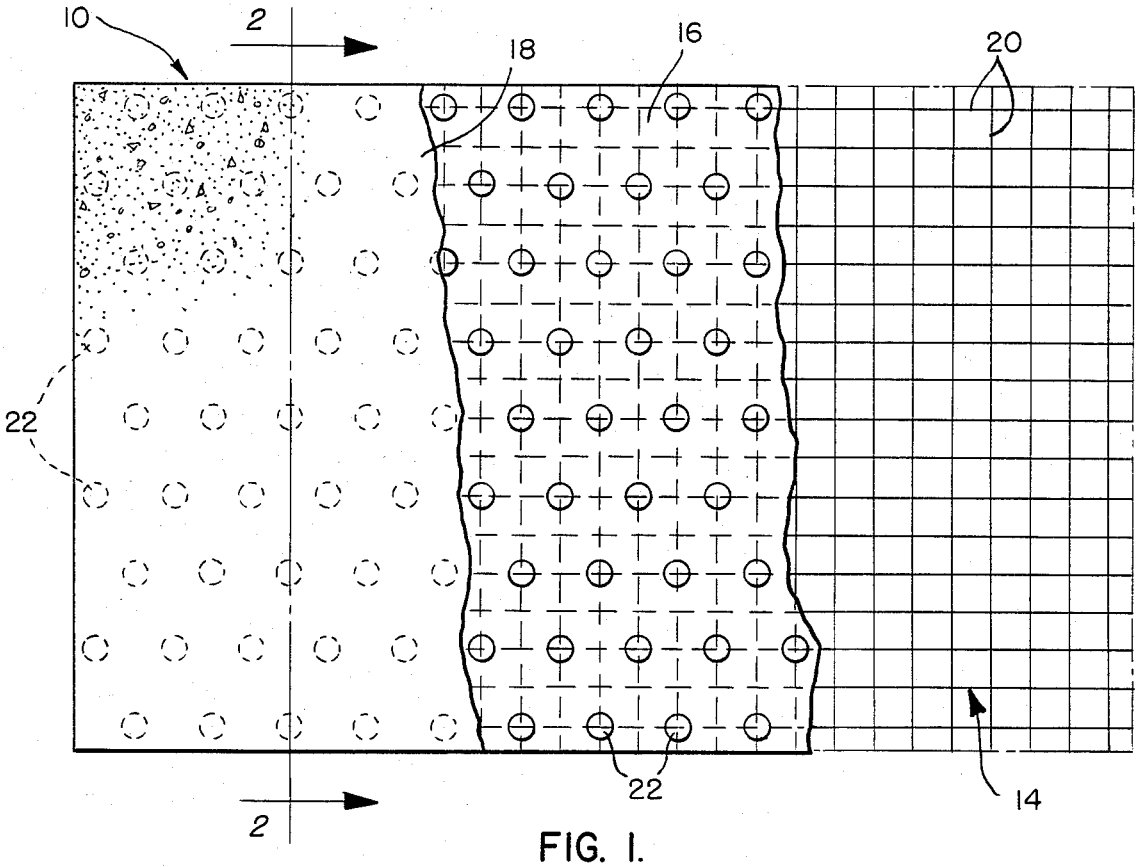
FIG. 1 is a plan view of a pavement module constructed according to the invention described and claimed herein.
Figure 2:
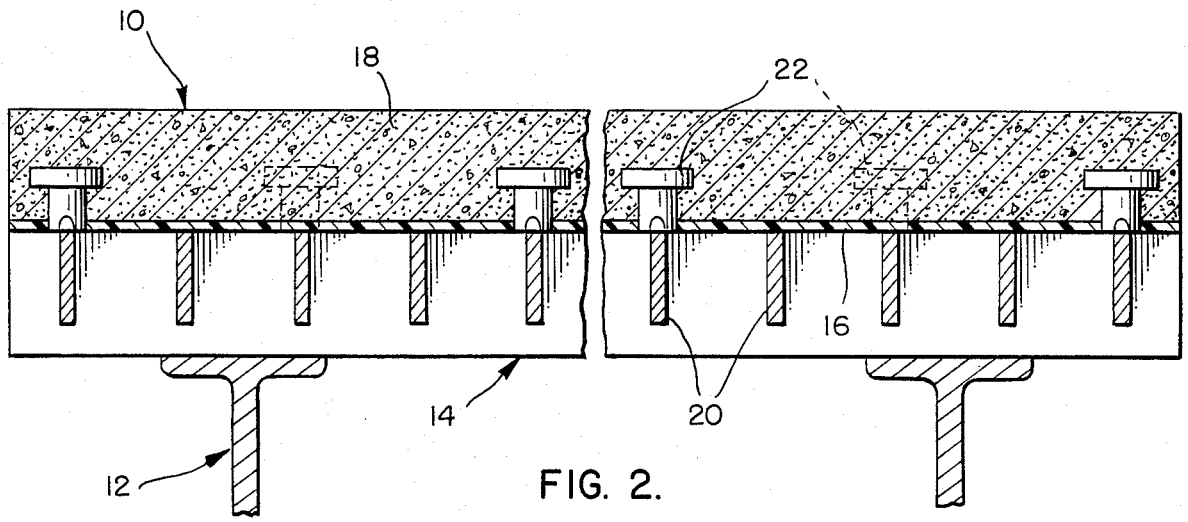
FIG. 2 is a cross-section of a pavement module taken along line 2—2 of FIG. 1.

The invention disclosed and claimed herein comprises a pavement module generally indicated at 10. The module is intended to be placed on a prepared road bed or bridge floor framing members as is generally shown at 12. In the preferred embodiment, the module includes a base layer 14, an intermediate layer 16 and a top layer 18.

In the preferred embodiment, the base layer is a metal grid or grating generally shown at 20. The grid is constructed in a conventional fashion with spaced parallel cross bars separated by interstices. The material and specifications of the grid are chosen to meet the particular load requirements and needs of the job. Studs or other shear connectors 22 are formed on the metal grid to pass through the intermediate layer and into the top layer to provide structural integrity of the pavement module and to permit the base layer and top layer to function in a complementary fashion. The metal grid may be either galvanized, coated with an epoxy, or otherwise protected from future deterioration.

Such protection coatings are well known in the art and typically lack the form of an organic, powdered epoxy resin applied to the grid by an electrostatic process. Galvanized, aluminum anodic and aluminum hot dip coatings are also well known and equally effective.

In a preferred embodiment, the intermediate layer 16 is a reinforced plastic or fiberglass sheet. This sheet is generally impervious to the passage of concrete material and serves to prevent the top layer from penetrating the base layer and filling the interstices of the base metal grid. The sheet also serves to protect the metal grid from the elements and this prevents premature deterioration. The primary purpose, however, of the intermediate sheet is to define the bottom surface of the concrete layer opposite the wear surface. Thus, the intermediate sheet may be a biogradable material, such as a reinforced paper sheet, which will deteriorate over time after the concrete cures. Once the concrete has cured and bonded to the metal grid and studs, the intermediate layer is no longer necessary to prevent the concrete from filling the interstices of the grid.

The top layer in the preferred embodiment is a high density low slump concrete, although other concrete formulations suitable as the wear surface may also be used. High density concrete is preferable because it serves as an additional barrier to prevent moisture from reaching the base member grid or grating and causing premature deterioration. A typical high density concrete would include approximately 31% each of coarse and fine aggregate; 6% air; 16% water; and 16% cement. A typical low slump might be approximately ¾ inch. A latex modified concrete, as is well known in the art, could also be used as the top layer. The concrete wearing surface can be much higher quality concrete than can be achievd when the wear surface is applied in the field since the concrete layer can be prepared under ideal conditions in a factory. In the preferred embodiment, the concrete layer should be approximately one and one-half to two inches thick.

Although the invention has been described with reference to a preferred embodiment, many changes will be apparent to those skilled in the art. The invention is defined and limited only by the following claims.

I claim:

1. A pavement module comprising:

an open-lattice grating base member having a plurality of primary load bearing bars and a plurality of secondary load bearing bars, said secondary load bearing bars intersecting and interlocked with said primary load bearing bars to distribute load transverse to said primary load bearing bars, said primary and secondary load bearing bars forming an integral modular unit adapted to be supported on and transmit forces to main structural framing members, said grating base member having a top surface and bottom surface;

a plurality of shear connectors integrally formed on said top surface of said grating base member; and a concrete wear member fixed to said grating base member above said top surface of said grating base member, said concrete wear member having a planar top surface and a planar bottom surface, said planar bottom surface essentially coplanar with said top surface of said grating base member so that said concrete wear member does not fill the interstices of said grating base member, said shear connectors embedded within said concrete wear member to effect horizontal shear transfer and to prevent vertical separation between said concrete wear member and said grating base member.

2. A pavement module as recited in claim 1 further comprising an intermediate member fixed to said grating base member which defines said top surface of said grating base member.

3. In a bridge wherein a pavement module forms a road bed supported by structural framing members of the bridge, the improved pavement module comprising:

an open-lattice grating base member having a plurality of primary load bearing bars and a plurality of secondary load bearing bars, said secondary load bearing bars intersecting and interlocked with said primary load bearing bars to distribute load transverse to said primary load bearing bars, said primary a nd secondary load bearings bars forming an integral modular unit having a top surface;

a plurality of shear connectors integrally formed on said top surface of said grating base member; and a concrete wear member having a planar top surface and a planar bottom surface, said planar bottom surface of said concrete wear member essentially coplanar with said top surface of said grating base member so that said concrete wear member does not fill the interstices of said grating base member, said shear connectors embedded within said concrete wear member to effect horizontal shear transfer and to prevent vertical separation between said concrete wear member and said grating base member.

4. The pavement module of claim 1 or 3 wherein said grating is a metal grating coated with epoxy.

5. The pavement module of claim 1 or 3 wherein said grating is a galvanized metal grating.

6. The pavement module of claim 1 of claim 1 or 3 wherein said concrete layer is high density, low slump concrete.

7. A pavement module as recited in claim 3 further comprising an intermediate member fixed to said grating base member which defines said top surface of said grating base member.

8. The pavement module of claim 2 or 7 wherein said intermediate member is a reinforced plastic sheet.

9. The pavement module of claim 2 or 7 wherein said intermediate member is a fiberglass sheet.

10. The pavement module of claim 2 or 7 wherein said intermediate member is a biodegradable sheet.

11. A road bed comprising:

an open-lattice grating base member having a plurality of primary load bearing bars and a plurality of secondary load bearing bars, said secondary load bearing bars intersecting and interlocked with said primary load bearing bars to distribute load transverse to said primary load bearing bars, said grating base member having a top surface and a bottom surface;

a plurality of shear connectors integrally formed on said top surface of said grating base member; and a concrete wear member fixed to said grating base member above said top surface of said grating base member, said concrete wear member having a planar top surface and a planar bottom surface, said planar bottom surface essentially coplanar with said top surface of said grating base member so that said concrete wear member does not fill the interstices of said grating base member, said shear connectors embedded within said concrete wear member to effect horizontal shear transfer and to prevent vertical separation between said concrete wear member and said grating base member.

12. A road bed as recited in claim 11 wherein said concrete wear member abuts said grating base member so that there is substantially planar contact between the top surface of said grating base member and said planar bottom surface of said concrete wear member.

* * * * *